US006514093B1

(12) United States Patent
Yu

(10) Patent No.: US 6,514,093 B1
(45) Date of Patent: Feb. 4, 2003

(54) WALL MOUNTING POWER ADAPTER SOCKET

(76) Inventor: Tsung-I Yu, No. 45, Sec. 3, Pa Te Rd., Pan Chiao City, Taipei (TW)

( * ) Notice: Subject to any disclaimer, the term of this patent is extended or adjusted under 35 U.S.C. 154(b) by 0 days.

(21) Appl. No.: 09/969,183

(22) Filed: Oct. 3, 2001

(51) Int. Cl.[7] ..... H01R 13/648
(52) U.S. Cl. ..... 439/105; 439/654
(58) Field of Search ..... 439/101–108, 439/620, 654, 650, 621, 622; 361/111, 118, 105, 115, 103

(56) References Cited

U.S. PATENT DOCUMENTS 3,131,013 A * 4/1964 Carlson ..... 439/105
3,775,727 A * 11/1973 Wise ..... 439/105
3,997,225 A * 12/1976 Horwinski ..... 439/105
4,659,161 A * 4/1987 Holcomb ..... 439/105 X
5,115,368 A * 5/1992 Smith ..... 361/105 X
5,272,587 A * 12/1993 Wan ..... 439/620 X
5,429,518 A * 7/1995 Chen ..... 439/107 X
5,742,464 A * 4/1998 Ceola et al. ..... 361/103
6,132,257 A * 10/2000 Wang et al. ..... 439/620

* cited by examiner

*Primary Examiner*—Brian Sircus
*Assistant Examiner*—Son V. Nguyen
(74) *Attorney, Agent, or Firm*—Varndell & Varndell, PLLC

(57) ABSTRACT

An improved design of a structure of a wall mounting power adapter socket to increase the number of outlets essentially by arranging all units of outlets on the surface of the socket casing in a longitudinal line so that only one stripe each of a fire Wire adaptive piece an earth wire and a grounding prong are required with each strip extending below each unit of pins for compact structure and cost reduction.

3 Claims, 5 Drawing Sheets

WALL MOUNTING POWER ADAPTER SOCKET

BACKGROUND OF THE INVENTION (a) Field of the Invention

The present invention relates to an improved design for a structure of a wall mounting power adapter socket. and more particularly to one that provides more outlets for wall mounting socket or socket with least number of outlet in a more compact. practical. and saving manufacturing and assembly costs.

(b) Description of the Prior Art:

As illustrated in FIGS. 1 and 2 of the accompanying drawings, the prior art of a structure of wall mounting power adapter socket is comprised of one casing 10 and two units of pins 20. Each of the units of pins 20 includes a firing wire blade 201, an earth wire blade 202 and a grounding prong 203 provided on the back of the casing 10 to be plugged into a wall socket for adapting electric power. Two rows of outlet units 30 are provided in the front of the casing 10. Each unit of outlets is comprised of a firing wire outlet 301, an earth wire outlet 302 and a ground prong socket 303 to receiver the insertion of plugs from electric appliances so to extend the supplied from a wall socket 100.

However, those units of outlets 30 are arranged in two rows and each unit of outlets 30 requires a fire wire adaptive piece, an earth wire adaptive piece and a grounding prong adaptive piece to be provided inside. Multiples of the adaptive piece must be provided inside each unit of outlets 30 and respectively matched to where below the two rows of outlets 30 for plugging into the wall socket. The internal structure for the adaptive socket has to be very complicate to accommodate so many adaptive pieces, resulting in increased manufacturing and assembly costs. Furthermore, the internal structure becomes more complicate since each of the two units of pins 20 requires to be connected to the fire wire earth wire and grounding prong adaptive pieces from each unit of outlets 30. Additional consumption of copper materials required for the adaptive pieces is a waste aid accounted for more production costs and troubles. summary of the invention.

The primary purpose of the present invention is to provide an improved design for a structure of wall mounting power adapter socket. To achieve the purpose, units of outlets on the surface of the casing of the socket are arranged in a longitudinal line, so that only one strip each of a fire wire adaptive piece, an earth wire and. a grounding prong are required. Each strip adaptive piece is then connected to a unit of pins provided on the back of the casing for compact structure and cost reduction.

Another purpose of the present invention is to provide an improved design for a structure of wall mounting power adapter socket. Within, multiples of sink are provided by punching between the strip fire adaptive and the earth adaptive pieces and having each of the sinks arranged below its corresponding outlet in the casing to receive plugging by electric appliance.

Another purpose yet of the present invention is to provide an improved design for a structure of wall mounting power adapter socket. Wherein, multiples of rectangular outlets are provided by punching between grounding prongs, and both side walls of each of the outlets extends askew an elastic piece to receive the insertion by a grounding plug from an electric appliance.

Another purpose yet of the present invention is to provide an improved design for a structure of wall mounting power adapter socket. Wherein, on an elected side by the unit of pins provided on the back of the casing, an insulation post is erected at a right angle. Upon plugging the unit of pins into the unit of outlets on one side of a wall socket, the insulation post is inserted into another unit of outlet on the other side to achieve more stable use of the power adaptive socket.

DETAILED DESCRIPTION OF THE PREFERRED EMBODIMENTS

Figure 1:
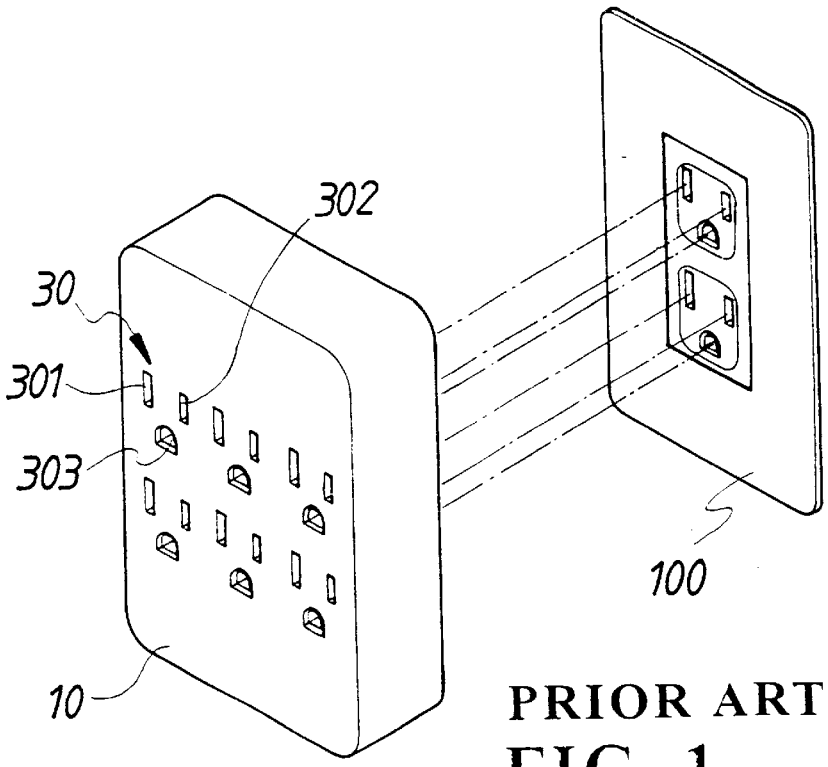
PRIOR ART FIG. 1
FIG. 1 is a perspective view of a wall mounting power adaptive socket of the prior art.
Figure 2:
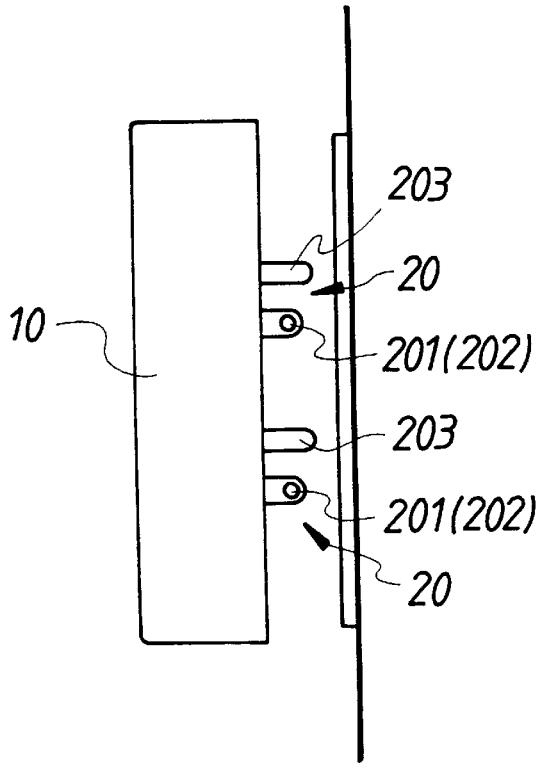
FIG. 2 PRIOR ART
FIG. 2 is a side view of a wall mounting power adaptive socket of the prior art.
Figure 3:
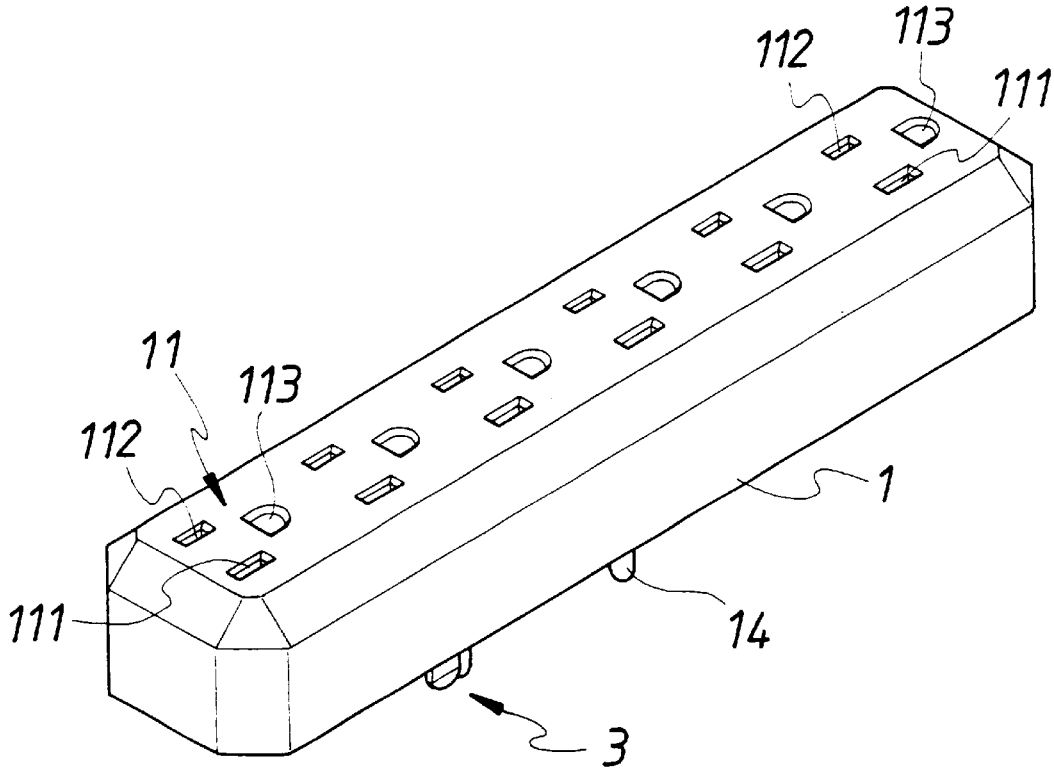
FIG. 3 is a perspective view of an assembly of a preferred embodiment of the present invention.
Figure 4:
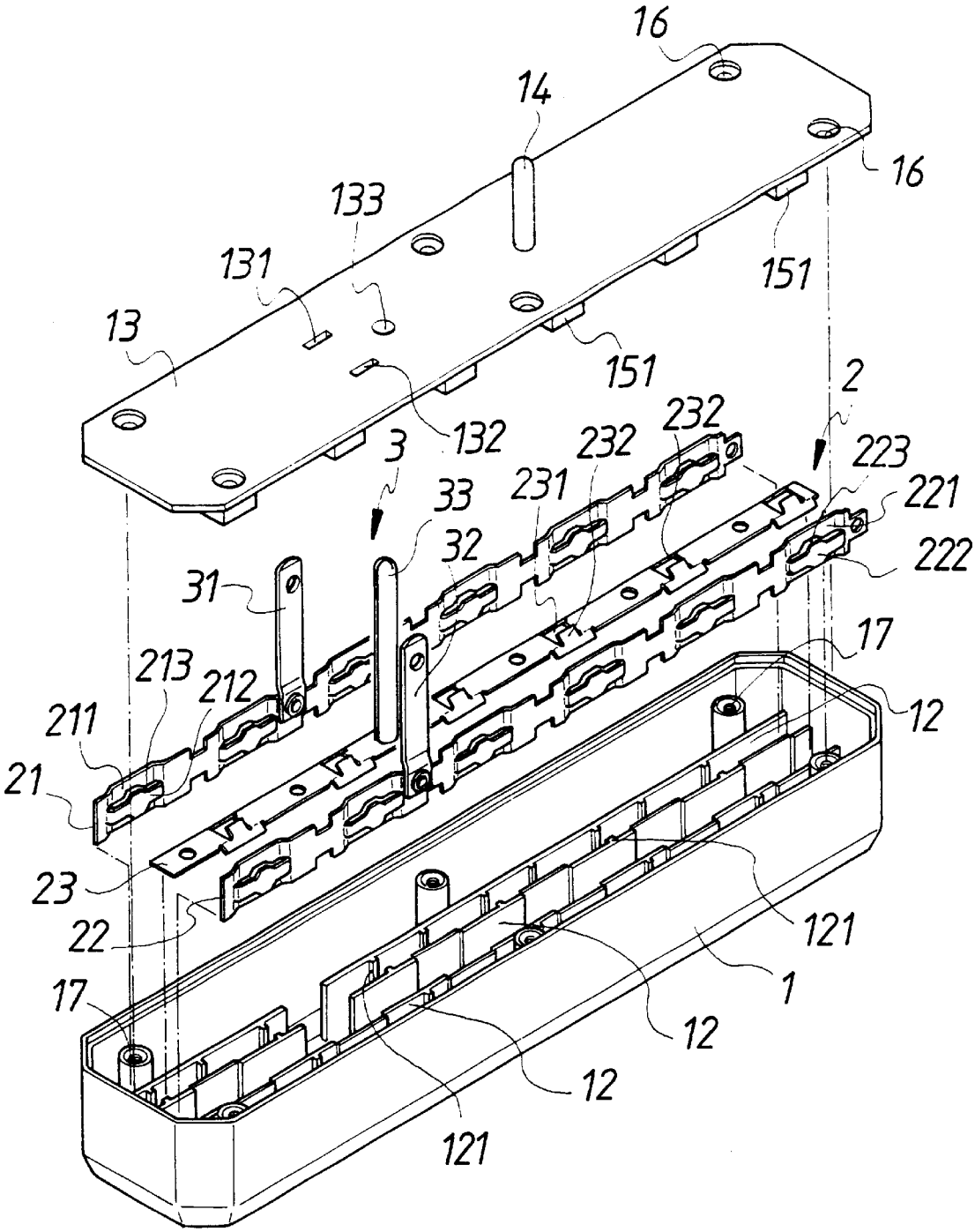
FIG. 4 is an exploded view of the preferred embodiment of the present invention.
Figure 5:
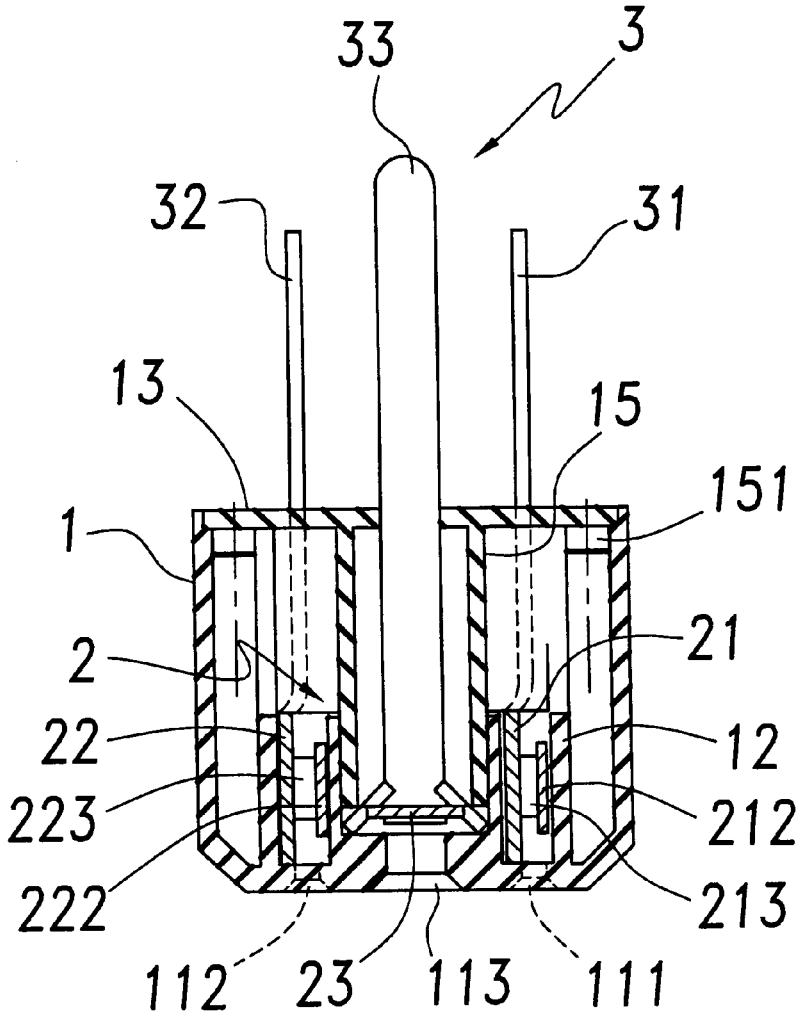
FIG. 5 is a sectional view of the assembly of the preferred embodiment of the present invention.

Referring to FIGS. 3 and 4, a design of a structure of a wall mounting power adapter socket of the present invention is essentially comprised of a casing 1, a unit of adaptive piece 2 and a unit of pins 3. The casing 1 as illustrated in FIGS. 3, 4 and 5, relates to a rectangular insulation member in shape of a staple, and multiples of units of outlets 11 longitudinally arranged in a single line are provided on the front of the casing 1. Each unit of outlets 11 including respectively on its both sides a through hole of a fire wire outlet 111, another through hole of an earth outlet 112 and a semi-circular grounding prong 112 above and between the two through holes. Two banks 12 are provided between an alley formed between both rows of the fire wire sockets 111 and the earth wire sockets 112 and ribs 121 at regular spacing are protruding from the banks 12 and arranged in facing each other from corresponding banks 12 to accommodate insertion of an adaptive piece. An insulation base 13 is provided at the bottom of the casing 1, and a unit of outlets also including a fire socket 131, an earth wire 132 and a grounding prong 133 is provided at an elected location on the back of the insulation base 13. An insulation post 14 is provided at an elected location on one side of the unit of socket on the insulation base 13, and a wall 15 is provided on both inner sides of the insulation base 13 with multiples of rectangular protrusions 151 provided on the outer side of each wall 15, and multiples of through holes 16 are respectively provided in the peripheral of the insulation base 13 to match inner screw holes 17 of the casing 1.

The unit of adaptive pieces 2 as illustrated in FIG. 4 is comprised of a fire wire adaptive piece 21, an earth wire adaptive piece 22 and a ground prong adaptive piece 23. Each of both of the fire adaptive piece 21 and the earth wire adaptive piece 22 relates to a strip copper piece and multiples of recesses 211, 221 are punched at a given spacing on each strip adaptive piece, a clipping piece 212, 222 is each formed by cutting into each recess 211, 221 to form thereby a sink 213, 223 for receiving the plugging in by an electric appliance; the grounding prong adaptive piece 23 also relates to a strip copper piece provided that multiple rectangular outlet 231 are provided thereon at a regular spacing and an elastic piece 232 each extending askew from both side walls of each outlet 231 to sandwich insertion of a grounding plug from the electric appliance.

The unit of pins as illustrated in FIG. 4 is comprised of a fire wire blade 31 an earth wire blade 32 and a grounding prong 33 with the fire wire blade 31 and the earth wire blade 32 made of sheet copper and the grounding prong 33 formed in a cylindrical shape.

Now referring to FIGS. 3 and 4, both of the fire wire blade 31 and the earth wire blade 32 are respectively riveted to the fire wire adaptive piece 21 and the earth wire adaptive piece 22 at where pre-elected and the grounding prong 33 is fixed onto the grounding prong adaptive piece 23 from the unit of adaptive nieces a. Accordingly the fire wire adaptive piece 21 is plugged in standing position into the fire wire socket 131 in the casing 1 and fixed in position by the side walls 12 of the fire wire socket 131. Similarly, the earth wire adaptive piece 22 is plugged in standing position into the earth. wire socket 132 in the casing and held in position by walls 12 on both sides of the earth wire socket 132. Meanwhile, the grounding prong adaptive piece 23 is laterally placed inside the grounding socket 113 and also held in position by the walls 12 on both sides of the grounding socket 1 13. Therefore, the fire wire blade 31, the earth blade 32 and the grounding prong 33 to extend vertically on the back of the casino 1. The insulation base 13 covers up the back side of the casino 1 leaving the fire wire blade 31, the earth wire blade 32 and the grounding prong 33 respectively to expose out of the fire wire socket 131. the earth wire socket 132 and the grounding socket 133 with the insulation base 13 to hold against the adaptive pieces 21, 22 and 23 with its internal walls 15 and protrusions 151.

Figure 6:
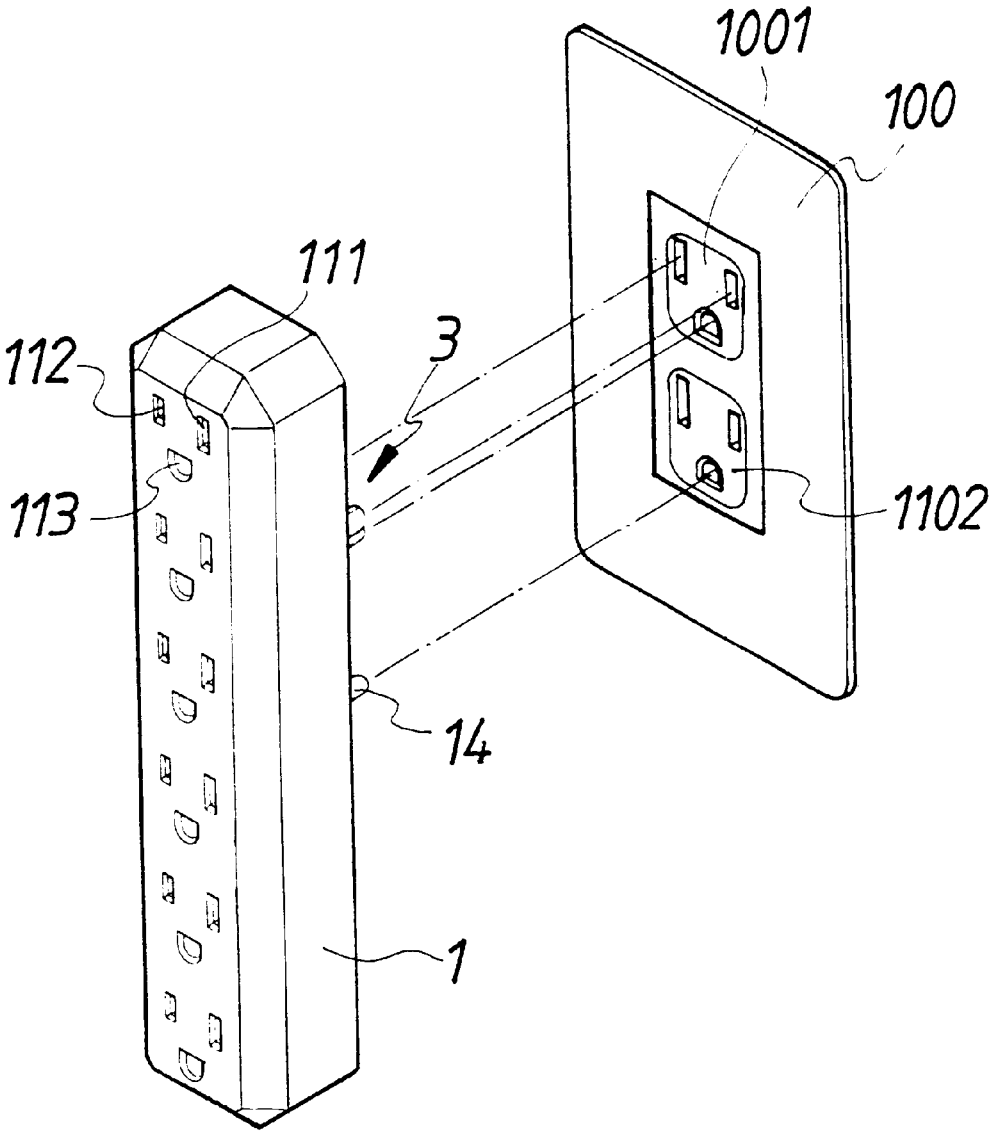
FIG. 6 is a schematic view showing operation of the preferred embodiment of the present invention.

As illustrated in FIG. 6, an assembly of the preferred embodiment of the present invention is plugged into a unit of outlets 1001 in a wall socket 100 with the unit of pins 3 extending through the back of the casing 1 for a fire wire power source to be conducted to the fire wire adaptive piece. Meanwhile, the insulation post 14 is also inserted into another unit of outlets 1002 by the unit of outlets 1001 in the wall socket 100 to help the power adapter socket be more secured while extending the maximal use of the wall socket 100 to receive multiples of plugs from various electric appliances.

By having arranged all the units of outlets 11 on the surface of the casing 1 of the power adaptive socket of the present invention into a single line, only one unit of adaptive pieces 2 comprised of one fire wire adaptive piece 2 1. one earth wire adaptive piece 22 and one grounding prong adaptive piece 23. is required to be provided inside the casino and each of the adaptive pieces 21, 22, 23 can be easily held positioned below each row of the outlets 111, 112, 113. Furthermore. one unit of pins 3 is provided on the back of the casing 1 to respectively and directly connected to the fire wire adaptive piece 21, the earth wire adaptive piece 22 and the grounding prong adaptive piece 23. Therefore the present invention features compact and practical combination of an internal structure to achieve the purpose of easy manufacturing and assembling, and thus the efficiency of cost reduction.

What is claimed is:

1. A wall mounting power adapter socket comprising a casing and a unit of electrically conductive pieces;

the casing having a rectangular-prism shape with a top and an opened bottom, the top of the casing having a plurality of openings, the plurality of openings arranged to form openings for more than two electric plug receptacles that extend in a longitudinal direction of the casing, the casing further having a plurality of insulating side walls extending in the longitudinal direction of the casing and extending from the top toward the opened bottom of the casing, and the side walls of the casing having ribs extending from the top toward the opened bottom of the casing;

the opened bottom of the casing being covered with an insulated bottom piece, the insulated bottom piece of the casing having an insulation post extending in a direction away from the top of the casing, and the insulated bottom piece further having two interior walls extending in the longitudinal direction of the casing about a middle section of the insulated bottom piece;

the unit of electrically conductive pieces being respectively made of copper and including a fire wire piece, an earth wire piece and a ground piece; each of the fire wire piece, the earth wire piece and the ground piece being integrally formed; the fire wire piece, the earth wire piece and the ground piece being arranged in parallel and separated from each other by the insulating side walls, where the insulating side walls with ribs receive and hold the fire wire piece and the earth wire piece in place; the ground piece being held in place by the two interior walls of the insulated bottom piece of the casing;

the fire wire piece including a single firing wire blade extending through the insulated bottom piece of the casing and a plurality of the recesses adapted for receiving a prong of an electric plug, the earth wire piece including a single earth wire blade extending through the insulated bottom piece of the casing and a recesses adapted for receiving another prong of an electric plug, the ground piece including a single ground prong extending through the insulated bottom piece of the casing and a plurality of the recesses for receiving a ground prong of an electric plug; and the single firing wire blade of the fire wire piece, the single earth wire blade of the earth wire piece, and the single ground prong of the ground piece being arranged at a location extending from the insulated bottom piece of the casing and adapted for insertion into a three-prong receptacle of an outlet having two three-prong receptacles; and the insulated post of the insulated bottom piece of the casing being arranged at a location adapted for insertion into a ground receptacle of another three-prong receptacle of an outlet having two three-prong receptacles.

2. A wall mounting power adapter socket as claimed in claim 1, wherein the fire wire piece and the earth wire piece are respectively punched at a given spacing forming the recess and corresponding clamping piece are formed by cutting into a respective recess to form a respective sink for receiving prongs of an electric plug.

3. A wall mounting power adapter socket as claimed in claim 1, wherein the grounding piece includes rectangular outlets provided at a given spacing, and elastic members extending askew from respective side walls of the rectangular outlets are adapted to receive a grounding prong from an electric plug.

* * * * *